US005884348A

United States Patent [19]

Onishi et al.

[11] Patent Number: 5,884,348

[45] Date of Patent: Mar. 23, 1999

[54] CRIB

[75] Inventors: Ichiro Onishi; Kenzou Kassai, both of Osaka, Japan

[73] Assignee: Aprica Kassai Kabushikikaisha, Osaka, Japan

[21] Appl. No.: 849,986

[22] PCT Filed: Oct. 17, 1996

[86] PCT No.: PCT/JP96/03009

§ 371 Date: Jun. 3, 1997

§ 102(e) Date: Jun. 3, 1997

[87] PCT Pub. No.: WO97/14339

PCT Pub. Date: Apr. 24, 1997

[30] Foreign Application Priority Data

Oct. 18, 1995 [JP] Japan ..... 7-270053

[51] Int. Cl.[6] ..... A47D 7/02; A47D 7/00

[52] U.S. Cl. ..... 5/93.2; 5/93.1; 5/100; 5/11

[58] Field of Search ..... 5/93.2, 93.1, 100, 5/11, 312

[56] References Cited

U.S. PATENT DOCUMENTS

| | | | |
|---|---|---|---|
| D. 300,697 | 4/1989 | Wallace et al. . | |
| 743,495 | 11/1903 | Hanley | 5/93.2 |
| 754,140 | 3/1904 | Hollis | 5/100 |
| 2,641,772 | 6/1953 | Cook | 5/93.1 |
| 2,698,442 | 1/1955 | Travis | 5/11 |
| 2,889,560 | 6/1959 | Carman | 5/100 |
| 2,932,344 | 4/1960 | Levi | 297/344.15 |
| 3,848,277 | 11/1974 | Reguitti | 5/100 |
| 3,900,907 | 8/1975 | Mulder | 5/100 |
| 4,097,942 | 7/1978 | Bridger . | |

FOREIGN PATENT DOCUMENTS

| | | | |
|---|---|---|---|
| 2642962 | 8/1990 | France | 5/611 |
| 50-140765 | 11/1975 | Japan . | |
| 51-24444 | 6/1976 | Japan | 5/93.2 |
| 59-50368 | 4/1984 | Japan . | |
| 63-117712 | 5/1988 | Japan . | |
| 6-7557 | 2/1994 | Japan | 5/93.1 |

OTHER PUBLICATIONS

J. C. Penney for Baby Catalog, c1995, p. 30, showing baby crib.

Child Craft, Cat.#41, Rec'd Apr. 13, 1992, p. 5, showing baby crib.

*Primary Examiner*—Alex Grosz

*Attorney, Agent, or Firm*—W. F. Fasse; W. G. Fasse

[57] ABSTRACT

A crib selectively serving as a baby bed and also as a playpen includes a bed floor member and respective panels enclosing the periphery of the bed floor member (13). At least one panel (12) is height-controllably supported by a base support (20) that also supports the bed floor member. In case of using the crib as a baby bed, the panel (12) is brought to a low position for enabling a mother or the like to readily care for the baby. In case of using the crib as a playpen, the panel is brought to a high position for safety reasons. The height of the bed floor member is also adjustable between high and low positions by adjusting the base support, which for example includes pivotable, tiltable or removable leg frame members.

18 Claims, 10 Drawing Sheets

CRIB

FIELD OF THE INVENTION

The present invention relates to a crib serving also as a playpen, and more particularly, it relates to a crib serving also as a playpen which can attain safety assurance responsive to the growth of a baby.

BACKGROUND INFORMATION

FIG. 5 discloses a typical crib serving also as a playpen. This crib 1 comprises a bed floor member 2, and panels 3*a*, 3*b*, 3*c* and 3*d* enclosing all peripheral sides of this bed floor member 2. The bed floor member 2 is supported at a height substantially at the centers of the panels 3*a*, 3*b*, 3*c* and 3*d*.

The state shown in FIG. 5 illustrates a form or configuration for use as a baby bed. In order to facilitate caring for a baby, it is desirable to maintain the height of the bed floor member 2 at a high position while lowering or reducing the height of the panels projecting upward beyond the bed floor member 2.

In case of using the crib 1 as a playpen, on the other hand, it is desirable to raise or increase the height of the panels projecting upward beyond the bed floor member, in consideration of safety for the baby playing in the playpen. In case of the crib 1 shown in FIG. 5, therefore, the bed floor member 2 is removed from the central portions of the panels 3*a*, 3*b*, 3*c* and 3*d* when the crib is used as a playpen. The removed bed floor member 2 is directly placed on a floor face enclosed by the panels 3*a*, 3*b*, 3*c* and 3*d*, or held on lowermost end portions of the panels, for example. In this case, the height of the panels projecting upward beyond the bed floor member 2 is raised or increased and the baby is prevented from getting over the panels.

In the crib serving also as a playpen shown in FIG. 5, it is necessary to remove and reposition the bed floor member 2 in response to each form of employment. A mattress or the like is placed on the bed floor member 2 in general, and hence the mattress or the like must also be removed with the bed floor member. Such an operation is troublesome for the mother.

The body of a baby becomes larger as it grows, while its movement also becomes more active. In order to use the crib over a long period, it is desirable to change the form of the crib in response to the growth of the baby. In this case, it is desired to assure the safety of the crib responsive to the growth of the baby.

OBJECTS OF THE INVENTION

An object of the present invention is to provide a crib serving also as a playpen which can achieve assurance of safety responsive to the growth of a baby.

Another object of the present invention is to make it possible to readily switch between a form of employment as a baby bed and a form of employment as a playpen.

Still another object of the present invention is to make it possible to switch between a form of employment as a baby bed and a form of employment as a playpen without removing a bed floor member.

A further object of the present invention is to enable a mother to readily care for a baby in the crib/playpen in the form of employment as a baby bed, while enabling the baby to safely play in the crib/playpen in the form of employment as the playpen.

A further object of the present invention is to make it possible to use a crib over a long period of time.

SUMMARY OF THE INVENTION

In a crib according to the present invention, a panel is height-controllably supported by a base support supporting a bed floor member. According to this structure, the height of the panel can be changed. In case of employing the crib as a baby bed, the panel is brought to a low position, in order to enable a mother or the like to readily care for a baby. In this state, the height of the panel projecting upward beyond the bed floor member is reduced, whereby the mother can readily care for the baby. In case of employing the crib as a playpen, on the other hand, the panel is brought to a high position. In this state, the height of the panel projecting upward beyond the bed floor member is raised or increased, which helps to prevent the dangerous situation that the baby playing in the playpen gets over the panel.

In the aforementioned crib, the form of employment as a baby bed and the form of employment as a playpen are switched by changing the height of the panel. Therefore, a troublesome operation of removing the bed floor member is unnecessary.

In order to height-controllably support the panel, the panel is supported by the base support to be slidable along the vertical direction, as one embodiment.

In a preferred embodiment, the base support comprises a support frame directly supporting the bed floor member, and a leg member height-controllably supporting the support frame. The panel is height-controllably supported by the support frame.

In the crib comprising the height-controllable support frame, the support frame is maintained at the highest position when the crib is used as a baby bed. In this case, the bed floor member is maintained at a high position, which avoids the inconvenience of the mother having to bend down extremely. In case of using the crib as a playpen, on the other hand, it is desirable to lower the bed floor member to a floor face, in view of safety. Thus, the support frame is brought to the lowest position.

As a preferable embodiment, the leg member includes a first leg frame and a second leg frame, respective upper end portions of which are rotatably coupled with each other. The support frame is supported by intermediate portions of the first leg frame and the second leg frame. The height of the support frame lowers or is reduced as the angle between the first leg frame and the second leg frame increases. Desirably, the first leg frame and the second leg frame are rendered to be capable of opening up to an angle of 180° and lining up on a straight line. In this state, the height of the support frame is most reduced, i.e. the support frame is at a-lowest position.

In another embodiment according to the present invention, the panel comprises a head part panel positioned on a head side, a foot part panel positioned on a foot side, and two side surface panels positioned on both side portions. Among the four panels, at least one side surface panel is supported to be height-controllable with respect to the base support. Preferably, the side surface panels can be moved into the minimum height position facilitating care for the baby, an intermediate height position suitable as a baby bed, and a maximum height position suitable as a playpen. Since a newborn baby does not turn in its sleep, there is no problem in safety even if the height of the side surface panels is brought to the lowest position. When the side surface panels are maintained at the lowest position, the mother or the like can readily care for the baby by changing its diaper or the like.

As the baby grows and then turns in its sleep, the side surface panels are brought to the intermediate height position, for preventing the baby from falling off of the bed floor, i. e. out of the bed. This intermediate height position is at a height that ensures safety for the baby, but does not give an oppressive feeling to the baby, and does not interrupt the view enabling the mother or the like to see the baby.

In case of using the crib as a playpen, the side surface panels are brought to the highest position. When the side surface panels are maintained at such a maximum height position, the panels help avoid the danger that the baby moving about in the playpen gets over the panels and out of the playpen.

In order to provide safety assurance that is responsive to the growth of the baby, preferably the base support comprises a support frame directly supporting the bed floor member, and a leg member supporting the support frame while separating the same upward from the floor face. When the crib is used as a baby bed, the support frame is held by the leg member at a position lifted or separated upwardly from the floor face. When the crib is used as a playpen, on the other hand, the leg member is folded, or removed, so that the support frame is directly in contact with the floor face.

In a preferred embodiment, the crib can be used as an extended bed by laying or tilting the foot part panel down to a horizontal position for enlarging the length of the bed floor, and by removing the two side surface panels, in order to use the crib over a long period of time.

DETAILED DESCRIPTION OF EXAMPLE EMBODIMENTS AND BEST MODE OF THE INVENTION

Figure 1:
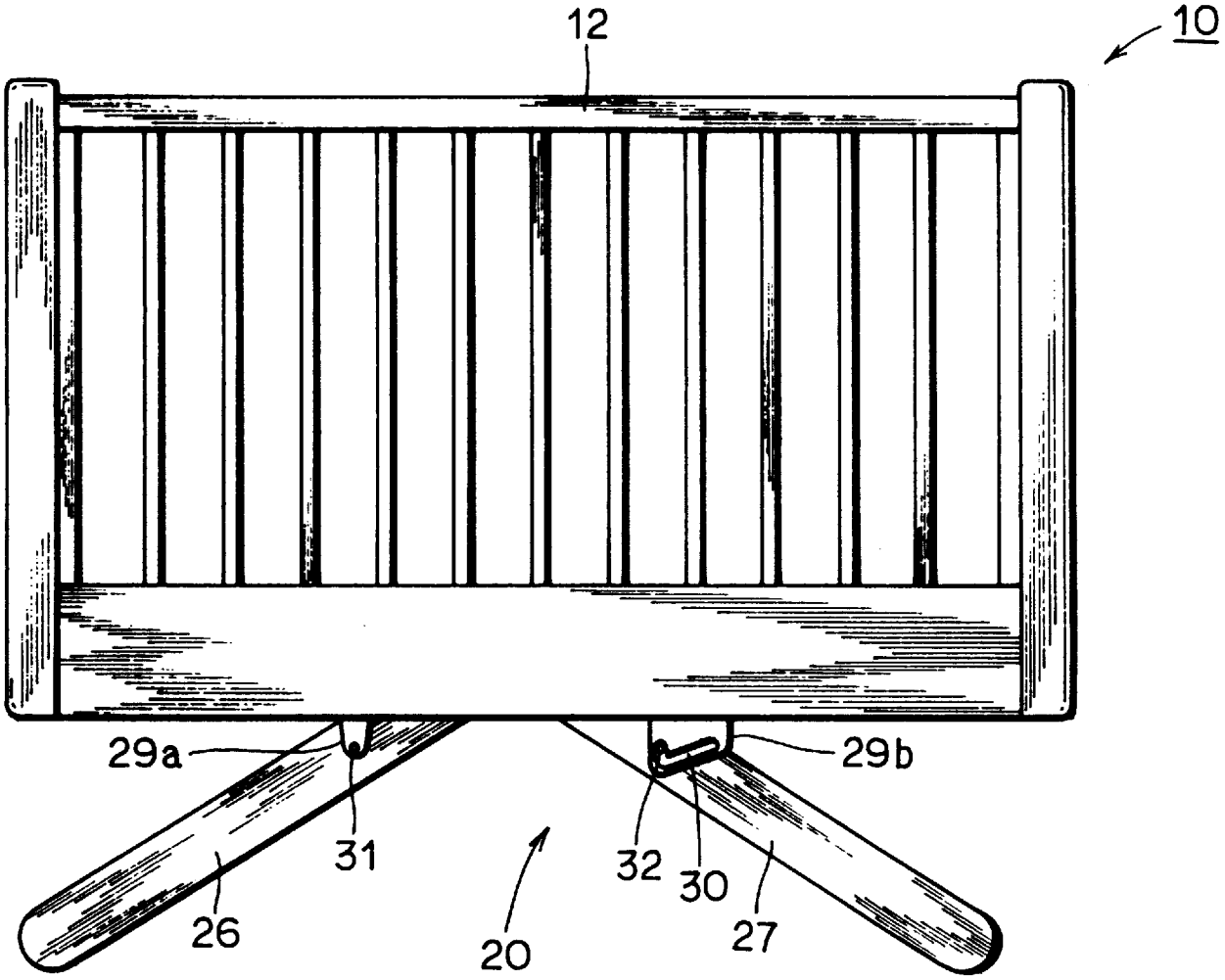
FIG. 1 is a side elevational view of an embodiment of the present invention.
Figure 2:
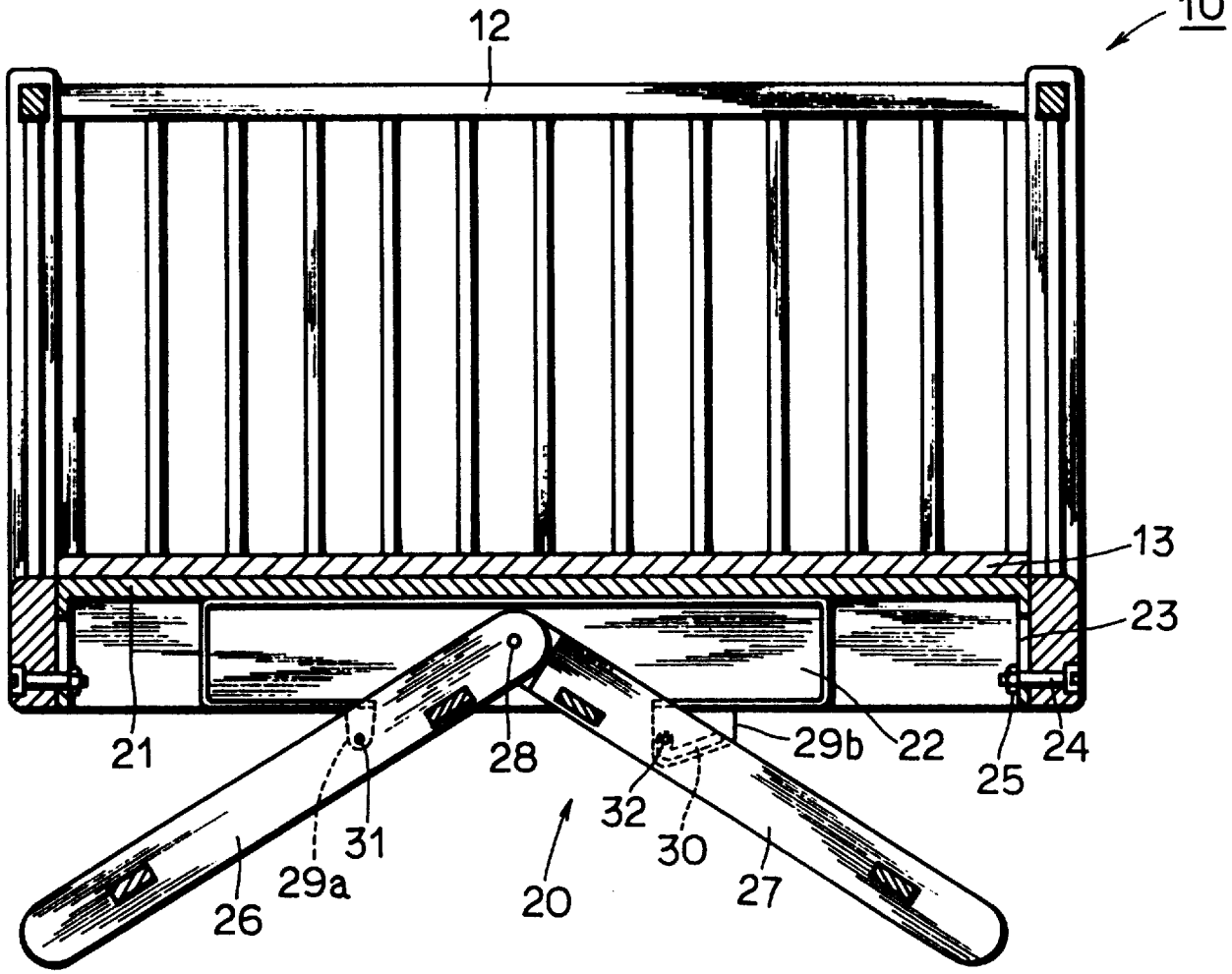
FIG. 2 is a sectional view of the embodiment of the present invention as viewed from a side portion.

A crib 10 shown in FIG. 1 and FIG. 2 comprises a respective panel 12 enclosing all peripheral sides of a bed floor member 13, and a base support 20 supporting the panel 12. The base support 20 includes a support frame 21 directly supporting the bed floor member 13 from below, a coupling plate 22 fixed to this support frame 21, a first leg frame 26, and a second leg frame 27.

As shown in FIG. 2, vertically extending slots 23 are formed in the support frame 21. The panel 12 is height controllably supported on the support frame 21 by bolts 24 passing through the slots 23 and nuts 25 fitted with these bolts. In the state shown in FIG. 2, the panel 12 is held by the support frame 21 on the lowest position.

As to the first leg frame 26 and the second leg frame 27, upper end portions thereof are rotatably coupled with each other through an axis 28. Mounting plates 29*a* and 29*b* are fixed to the coupling plate 22. A slot 30 extending substantially in a V-shape is formed in the mounting plate 29*b*. The first leg frame 26 and one mounting plate 29*a* are rotatably coupled with each other through an axis 31. An axis 32 passing through the slot 30 of the mounting plate 29*b* is fixed to the second leg frame 27.

As clear from the structure shown in FIG. 2, the support frame 21 is height-controllably supported by the first leg frame 26 and the second leg frame 27. As the angle between the first leg frame 26 and the second leg frame 27 increases, the height of the support frame 21 lowers. The angle between the first leg frame 26 and the second leg frame 27 is fixed in the state shown in FIG. 2, whereby the height of the support frame 21 is maintained.

In the state shown in FIG. 2, the crib 10 is used as a form of a baby bed. The panel 12 is supported by the support frame 21 on a low position, and hence the height of the panel 12 projecting upward beyond the bed floor member 13 is relatively low. Further, the support frame 21 is supported at a relatively high position by the first leg frame 26 and the second leg frame 27, and hence the bed floor member 13 is maintained at a high position. Therefore, a mother can readily care for a baby lying on the bed floor member 13.

Figure 3:
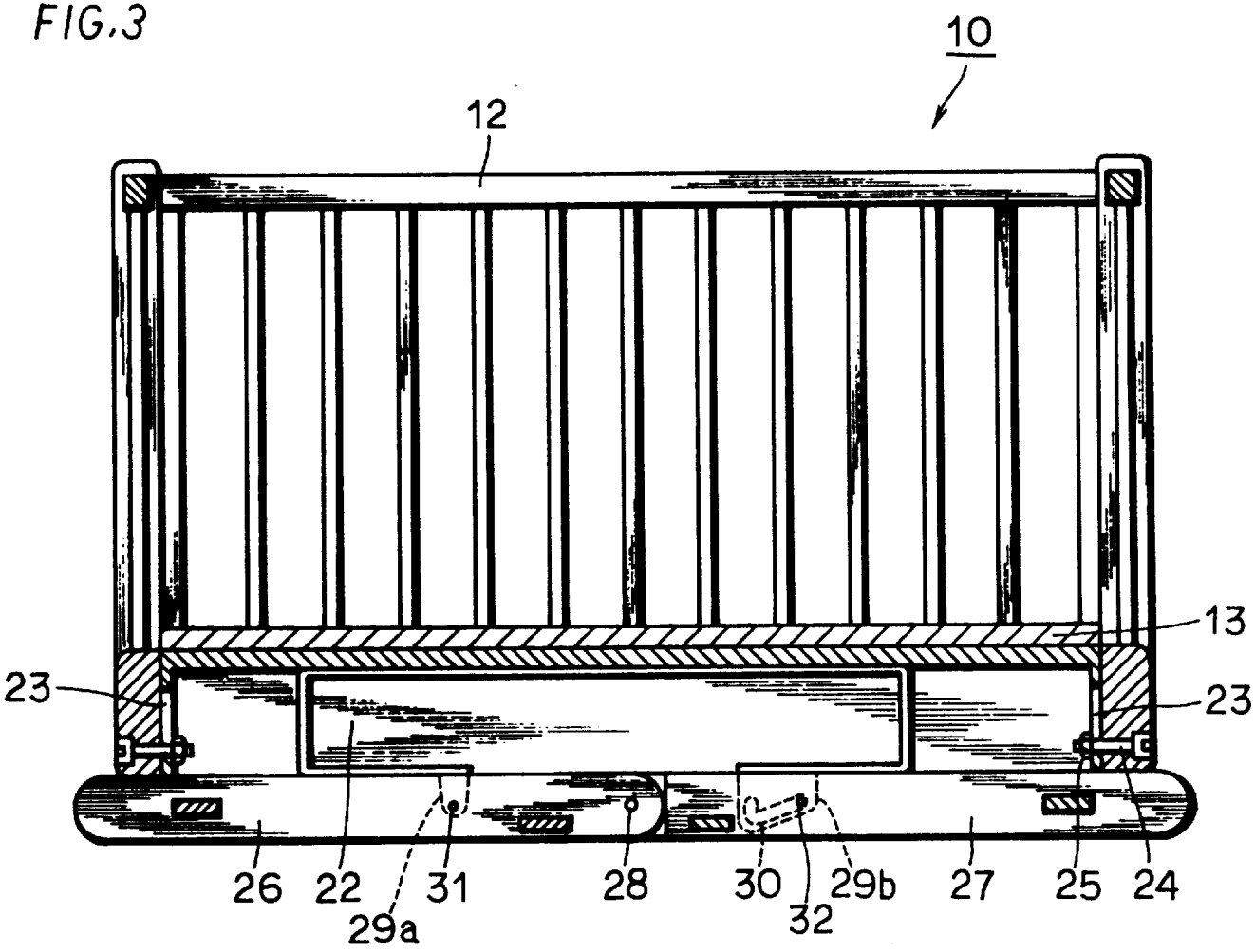
FIG. 3 is a sectional view of the embodiment of the invention in a state in which a first leg frame and a second leg frame are opened or spread apart at 180° relative to each other.

In case of using the crib 10 as a playpen, the angle between the first leg frame 26 and the second leg frame 27 is greatly increased first as shown in FIG. 3, for lowering the height of the support frame 21. In the illustrated embodiment, the first leg frame 26 and the second leg frame 27 open up to an angle of 180° and line up on a straight line. For this operation, the axis 32 passing through the mounting plate 29*b* may be merely moved along the slot 30. The first leg frame 26 and the second leg frame 27 extend on and along a floor face in the state shown in FIG. 3, whereby the support frame 21 is stably held on a low position.

Figure 4:
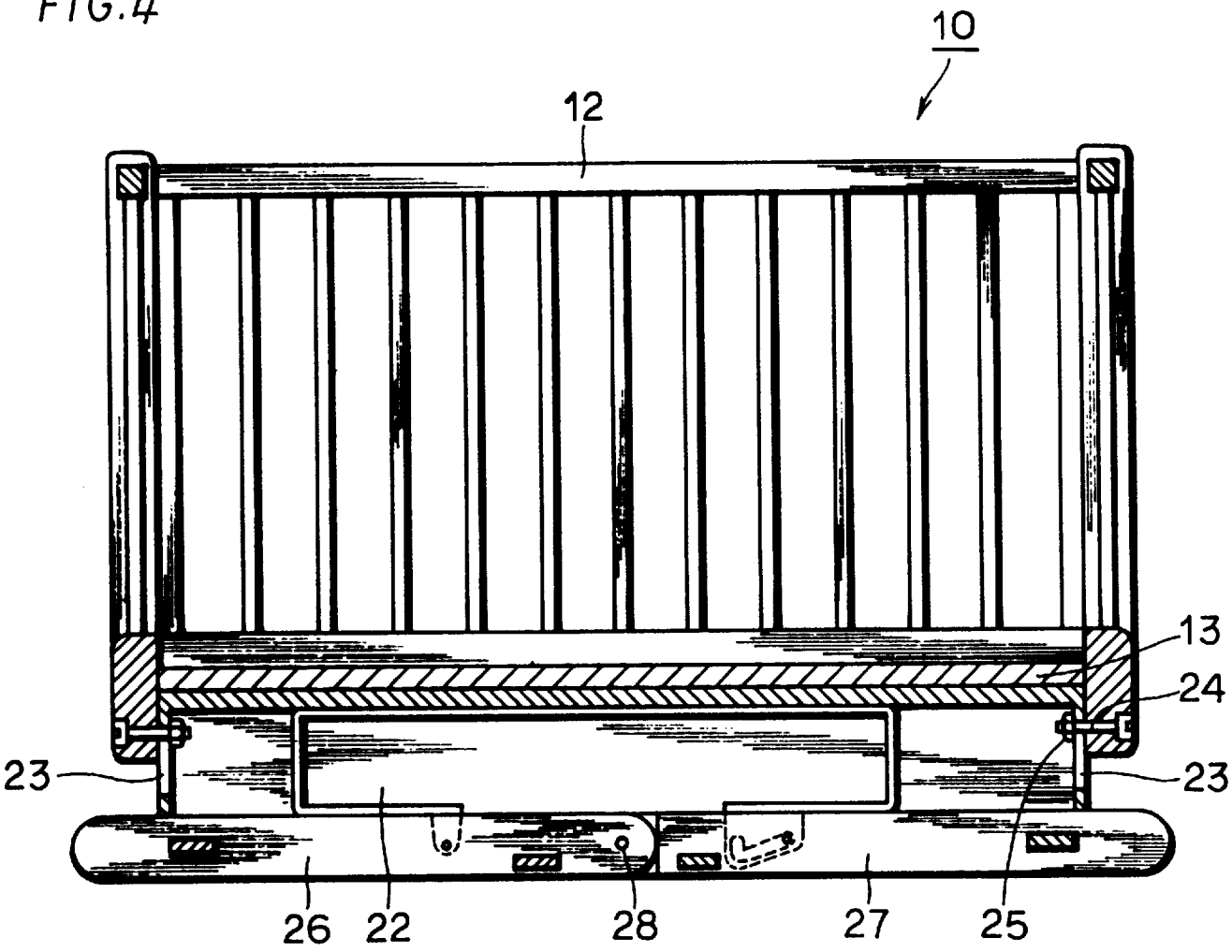
FIG. 4 is a sectional view of the embodiment of the invention in a state bringing a panel to an upper position.
Figure 5:
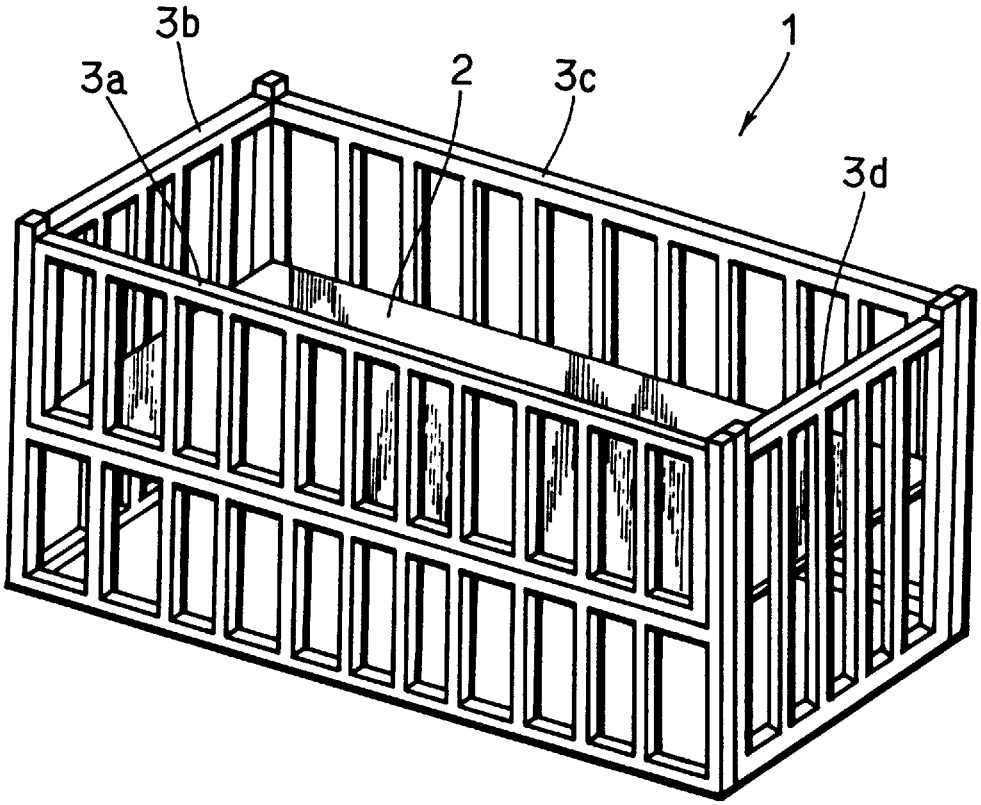
PRIOR ART FIG.5
FIG. 5 is a perspective view showing a conventional crib serving also as a playpen.

From the state shown in FIG. 3, further, the bolts 24 are loosened for slide-moving the panel 12 upward on the support frame 21. Then, the bolts 24 are fixed in a state shown in FIG. 4. A form shown in FIG. 4 is preferable for employment as a playpen. Since the panel 12 has been slide-moved upward, the height of the panel 12 projecting upward beyond the bed floor member 11 is raised or increased. Therefore, the dangerous situation that the baby playing in the playpen gets over the panel is expected to be avoided. Further, the bed floor member 13 is brought to a low position by opening the first leg frame 26 and the second leg frame 27 at 180°, whereby this is desirable in the point of safety, and it is possible to let the baby play in the playpen without concern.

In the embodiment shown in FIG. 2 to FIG. 4, it is not necessary to remove the bed floor member 13 for switching the crib between the form of employment as a baby bed and the form of employment as a playpen. While the support frame directly supporting the bed floor member has been height-controllably supported by the leg member in the illustrated embodiment, the height of the support frame may be fixed. For example, the crib may be used as a baby bed by simply moving the panel 12 downward in the state shown in FIG. 4.

Figure 6:
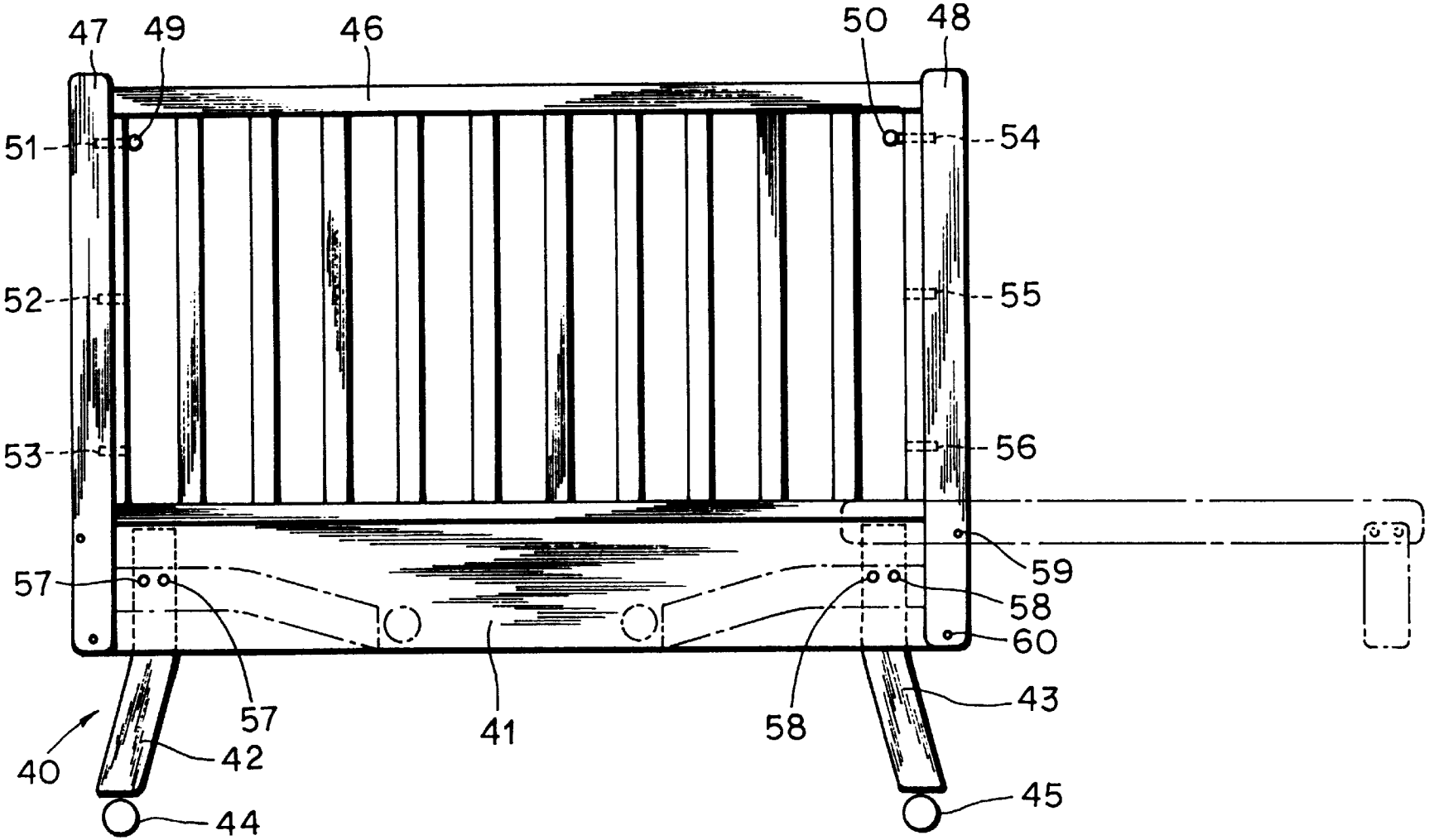
FIG. 6 is a side elevational view of another embodiment of the present invention.

FIG. 6 illustrates another embodiment of the present invention. The illustrated crib serving also as a playpen comprises a respective panel enclosing all peripheral sides of a bed floor member, and a base support 40 supporting the bed floor member. The base support 40 comprises a support frame 41 directly supporting the bed floor member from below, and first and second leg frames 42 and 43 which are fixed to this support frame 41 through screws 57 and 58. The first and second leg frames 42 and 43 have casters 44 and 45 on lower ends thereof.

Although not illustrated in FIG. 6, a pair of front frames 47 have a head part panel therebetween. Similarly, a pair of rear frames 48 have a foot part panel therebetween.

Side surface panels 46 and 61 (refer to FIG. 6 and FIG. 7) are arranged on both side portions of the crib. In the illustrated embodiment, one side surface panel 46 among the four panels is height-controllably provided with respect to the base support 40. Concretely, the side surface panel 46 is provided to be vertically slidable between the front frame 47 and the rear frame 48. The side surface panel 46 comprises lock pins 49 and 50. These lock pins 49 and 50 engage in any ones of holes 51, 52, 53, 54, 55 and 56 formed on the front frame 47 and the rear frame 48, so that the side surface panel 46 is fixed and held at any selected one of three stages of height positions.

The first leg frame 42 and the second leg frame 43 can be separated from the support frame 41 by removing the screws 57 and 58. In this case, the removed first and second leg frames 42 and 43 may be stored in the support frame 41 to be fixed and held, as shown by phantom lines in FIG. 6.

The rear frame 48 is fixed to the support frame 41 through screws 59 and 60. When the screw 60 is removed and the screw 59 is loosened, the rear frame 48 can rotate about the screw 59. When the rear frame 48 is laid or tilted down to enter a horizontal state as shown by phantom lines in FIG. 6, the length of the bed floor member can be extended.

Figure 7:
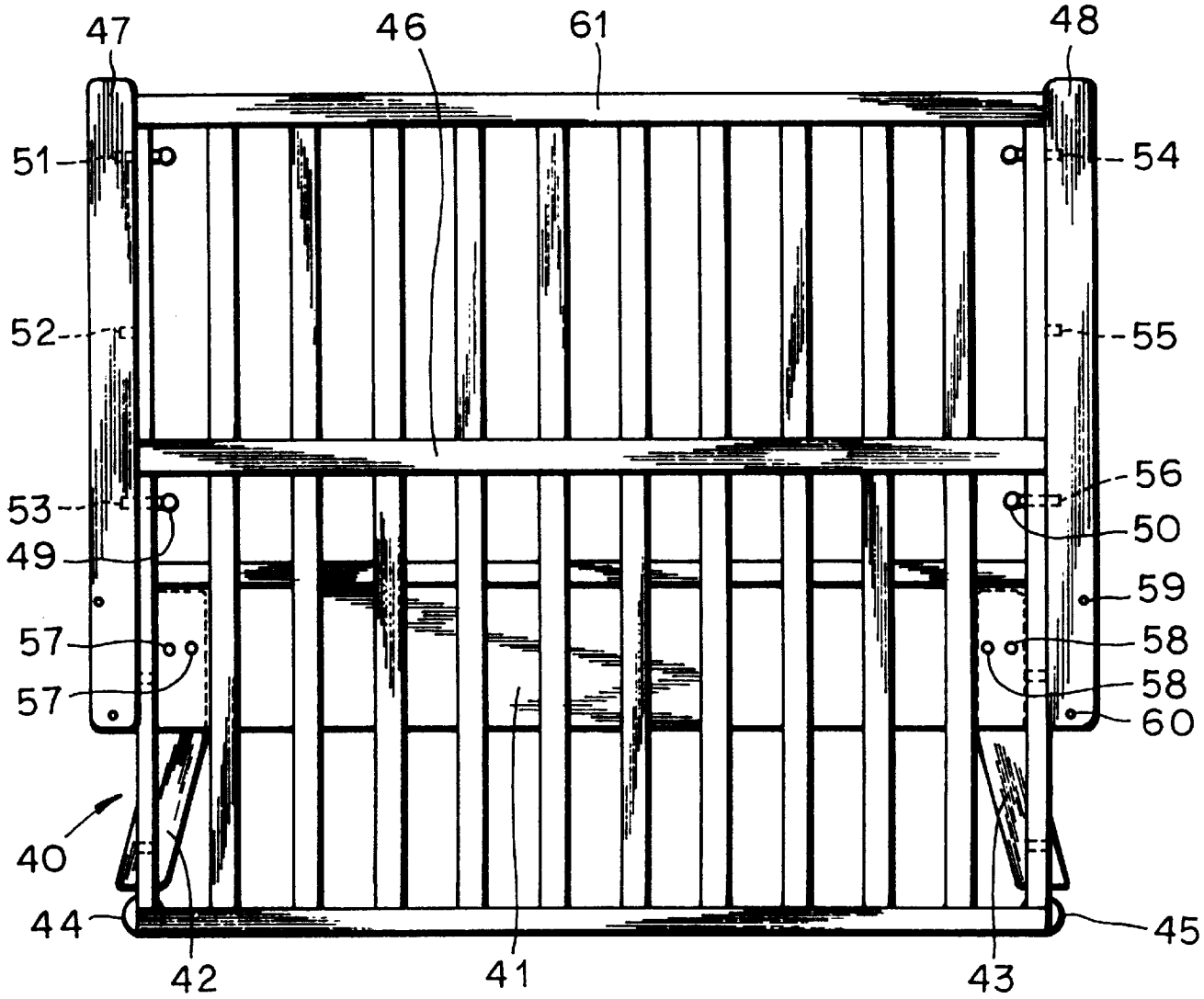
FIG. 7 is a side elevational view of the second embodiment of FIG. 6 in a state bringing a side surface panel to a minimum height position.

The crib shown in FIG. 6 is changed to various forms in response to the growth of a baby. FIG. 7 shows a form of the crib suitable for a stage of a newborn baby. The support frame 41 is supported by the first and second leg frames 42 and 43 to be separated upward away from a floor face. One side surface panel 46 is brought to a minimum height position. The newborn baby does not turn in its sleep, and hence there is generally not expected to be a particular problem in safety even if the side surface panel 46 is brought to the minimum height position. The support frame 41 is maintained at a high position by the first and second leg frames 42 and 43 while the side surface panel 46 is brought to the minimum height position, whereby the mother or the like can readily care for the baby.

Figure 8:
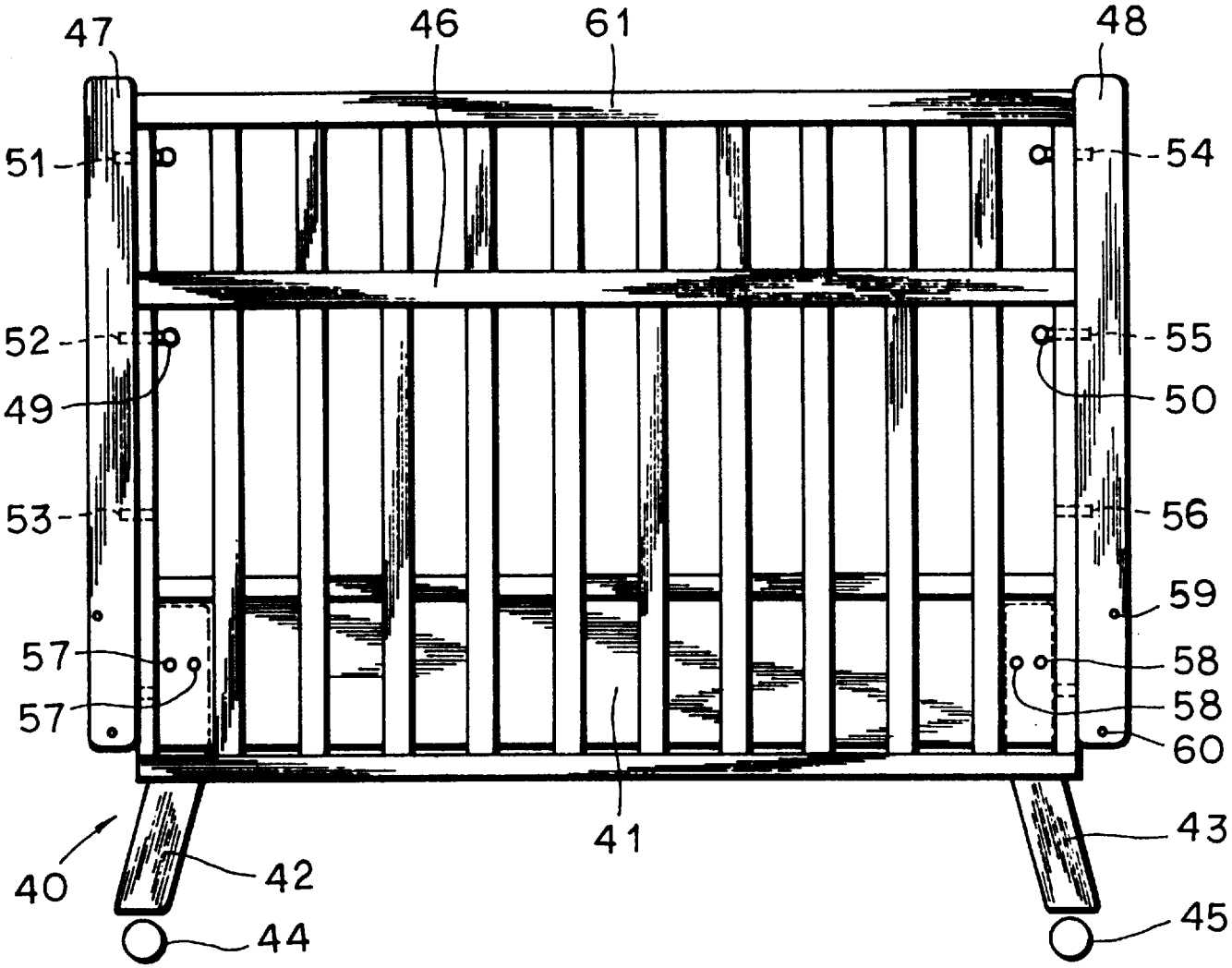
FIG. 8 is a side elevational view of the second embodiment in a state bringing the side surface panel to an intermediate height position.

FIG. 8 shows a form of the crib which is suitable for such a case or stage in which the baby grows and its movement becomes active. The side surface panel 46 is brought to an intermediate height position. This intermediate height position of the side surface panel 46 is at a height for intending to prevent the baby who is laid in the crib from falling out of the crib even if it moves actively. Considering only safety, it is desirable to maintain the height of the side surface panel 46 at a high position. However, it is not preferable to bring the side surface panel 46 to a higher position than necessary, since this gives an oppressive feeling to the baby and interrupts the view of the mother or the like to the baby. From such a viewpoint, it is desirable to fix and hold the side surface panel 46 in the intermediate height position. Even if the crib is in the form shown in FIG. 8, it is desirable that the side surface panel 46 is brought to the minimum height position at the time of caring for the baby so that the mother or other caregiver can more easily reach and handle the baby.

Figure 9:
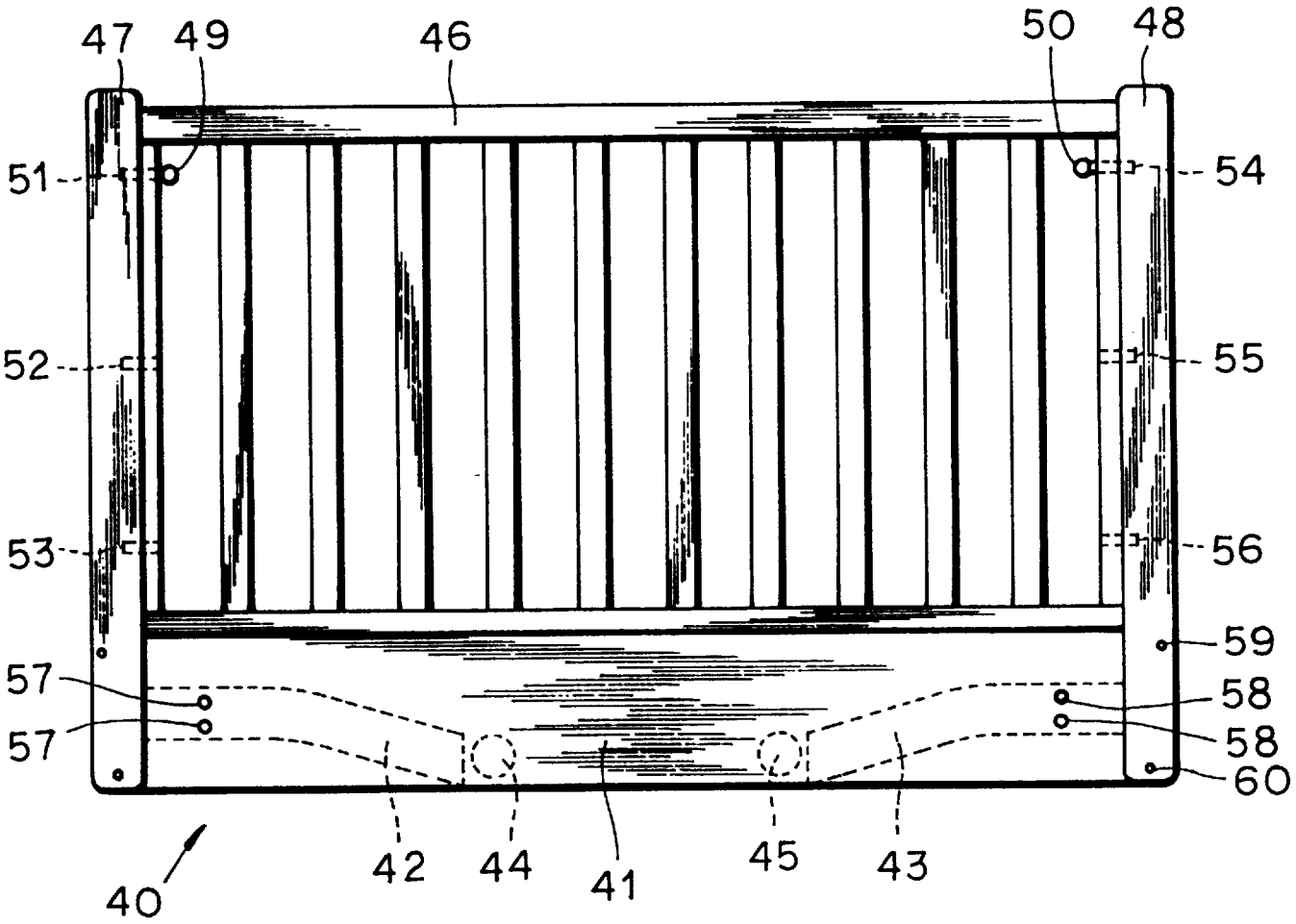
FIG. 9 is a side elevational view of the second embodiment in a form used as a playpen.

FIG. 9 illustrates a form suitable as a playpen. The first and second leg frames 42 and 43 are folded to be fixed and held in the support frame 41. Therefore, the support frame 41 directly comes into contact with the floor face. In other words, the bed floor member comes to a low position relatively near the floor face, whereby safety for the baby playing on this bed floor member is increased. The side surface panel 46 is brought to a maximum height position. Thus, this arrangement intends to avoid the dangerous situation that the baby playing in the playpen gets over the side surface panel 46.

Figure 10:
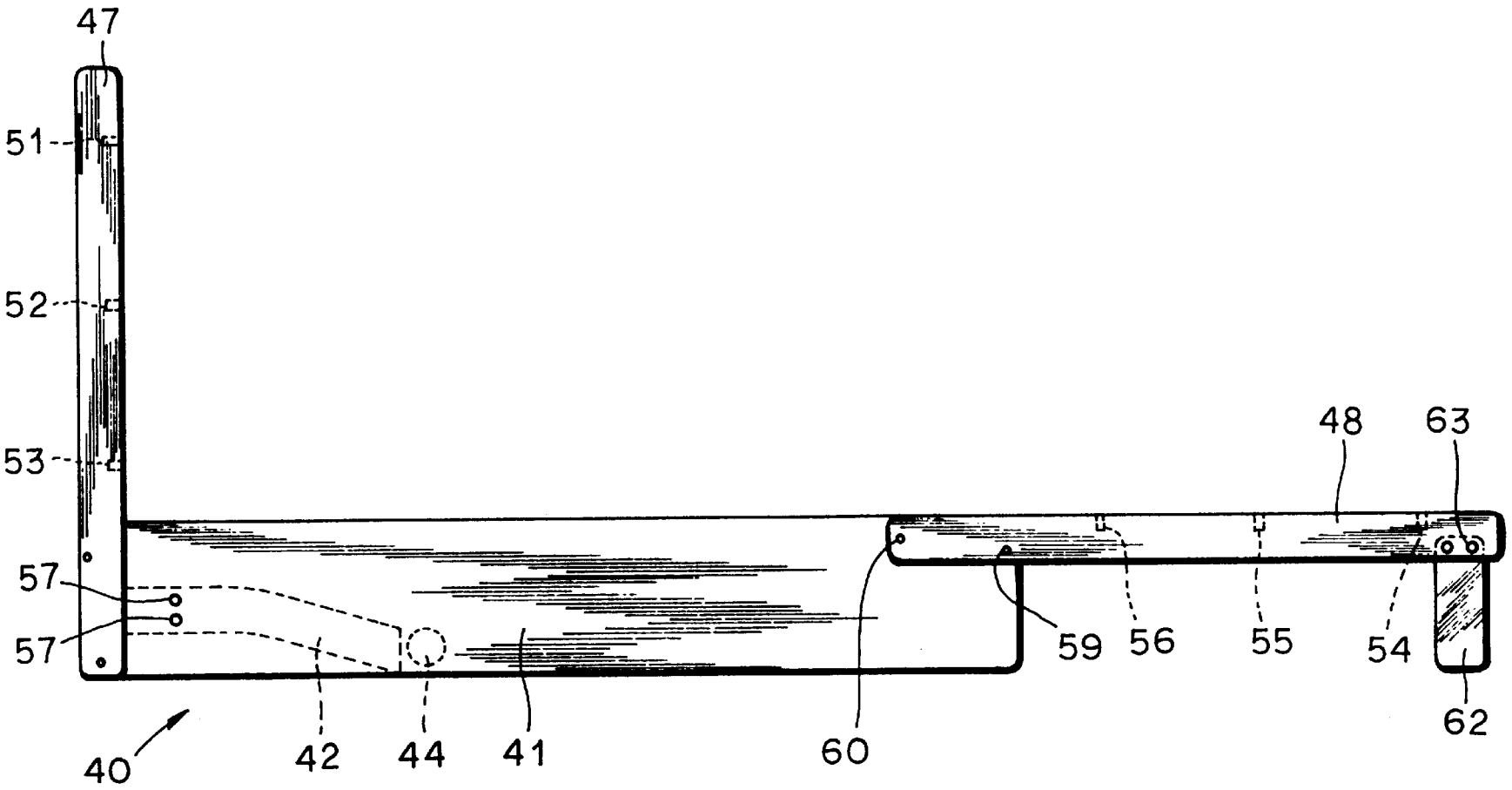
FIG. 10 is a side elevational view of the second embodiment in a form used as an extended bed.

FIG. 10 illustrates a form used as an extended bed following further growth of the baby. The first and second leg frames 42 and 43 are folded to be stored, fixed and held in the support frame 41. The two side surface panels 46 and 61 are removed, and the foot part panel along with the rear frame 48 are laid or tilted down until the same enter a horizontal state. A forward end portion of the rear frame 48 is supported by an auxiliary leg member 62 mounted thereon with screws 63 to be held above the floor face. Thus, the length of the bed floor member is extended by utilizing the foot part panel which is laid in the horizontal state. The first and second leg frames are folded in this state, whereby the height of the bed floor member is set and maintained at a low position. Therefore, no serious injury would be expected to result even if a child lying on the extended bed falls off of the bed floor.

While the present invention has been described in relation to the illustrated embodiments, various alterations and modifications are possible within the scope of the present invention.

For example, the first and second leg frames 42 and 43 have been folded in the aforementioned embodiment, in case of using the crib as a playpen. If it is confirmed that adequate safety is provided in the particular circumstances, however, the crib may be used as a playpen in the state being supported on the extended first and second leg frames 42 and 43. In such an embodiment, a form suitable as a baby bed and a form suitable as a playpen can be switched by simply moving one side surface panel up and down.

When only one side surface panel 46 is removed in the state shown in FIG. 6 or the state shown in FIG. 9, the crib can be used as a sofa.

We claim:

1. A crib that is selectively configurable into a first configuration in which said crib is adapted for use as a baby bed and a second configuration in which said crib is adapted for use as a playpen, said crib comprising a bed floor member, a base support arranged to support said bed floor member relative to a floor surface, an adjustable panel extending upwardly at a peripheral edge of said bed floor member and being height adjustably movably arranged relative to said base support, two corner post members connected to and extending upwardly from said base support and supporting said adjustable panel, which is arranged to be vertically slidably held between said two corner post members, and a lock pin selectively engageable into any selected one of at least three vertically spaced height adjustment holes provided in said two corner post members to selectively adjust said adjustable panel into first, second and third respectively different panel heights.

2. The crib in accordance with claim 1, wherein said base support comprises a support frame that directly supports said bed floor member, and a leg member that has an adjustable height and that height-adjustably supports said support frame relative to the floor surface, and wherein said adjustable panel is height-adjustably connected to and supported by said support frame via said two corner post members.

3. The crib in accordance with claim 2, wherein said leg member includes a first leg frame and a second leg frame having respective upper end portions rotatably coupled with each other, said support frame is supported on intermediate portions of said first leg frame and said second leg frame, and said support frame and said leg frames are connected together in such a manner that the height of said support frame above the floor surface is made lower as the angle between said first leg frame and second leg frame is increased.

4. The crib in accordance with claim 3, wherein said first leg frame and said second leg frame are connected to each other in such a manner so as to be capable of pivoting to have an angle of 180° therebetween and lining up with each other in a linearly aligned state, and said support frame is at a lowest height when said leg frames are in said linearly aligned state.

5. The crib in accordance with claim 2, wherein said adjustable panel is supported by said base support via said two corner post members in a lower one of said panel heights, and said support frame is supported by said leg member in a high support frame position in said first configuration in which said crib is adapted for use as a baby bed, and said adjustable panel is supported by said base support via said two corner post members in a higher one of said panel heights, and said support frame is supported by said leg member in a low support frame position in said second configuration in which said crib is adapted for use as a playpen.

6. The crib in accordance with claim 1, wherein said adjustable panel is supported by said base support via said two corner post members in a lower one of said panel heights in said first configuration in which said crib is adapted for use as a baby bed, and said adjustable panel is supported by said base support via said two corner posts in a higher one of said panel heights in said second configuration in which said crib is adapted for use as a playpen.

7. The crib in accordance with claim 1, wherein said adjustable panel comprises a first side surface panel positioned along a first side peripheral edge of said bed floor member, and further comprising a head part panel positioned on a head side peripheral edge, a foot part panel positioned on a foot side peripheral edge, and a second side surface panel positioned on a second side peripheral edge of said bed floor member, and wherein said first side surface panel is height-adjustably supported with respect to said base support by said two corner post members.

8. The crib in accordance with claim 7, wherein said first panel height is a minimum height position easing care for a baby in said crib, said second panel height is an intermediate height position in said first configuration, and said third panel height is a maximum height position in said second configuration.

9. The crib in accordance with claim 1, wherein said base support comprises a support frame directly supporting said bed floor member, and a leg member supporting said support frame upward from the floor surface, said support frame is supported by said leg member in a high position spaced upward from the floor surface in said first configuration in which said crib is adapted for use as a baby bed, and said leg member is foldably or removably connected to said support frame such that said leg member can be folded or removed so that said support frame is directly in contact with the floor surface in said second configuration in which said crib is adapted for use as a playpen.

10. A crib that is selectively configurable into a first configuration in which said crib is adapted for use as a baby bed and a second configuration in which said crib is adapted for use as a playpen, said crib comprising:

a bed floor member extending horizontally;

a base support frame directly supporting said bed floor member;

an adjustable height leg arrangement connected to said base support frame in such a manner so as to support said base support frame relative to a floor surface selectively at a first base height in said first configuration and at a second base height lower than said first base height in said second configuration; and a total of four adjustable crib wall panels respectively extending vertically upwardly along a peripheral edge of said bed floor member, wherein each one of said adjustable wall panels is adjustably connected to said base support frame in such a manner so that said adjustable wall panel can be selectively supported relative to said base support frame at a first panel height in said first configuration and at a second panel height higher than said first panel height in said second configuration.

11. The crib in accordance with claim 10, further comprising bolts, wherein said base support frame has vertically elongated slot holes therein, and said bolts pass through said slot holes to height adjustably secure said wall panels directly to said base support frame.

12. The crib in accordance with claim 11, wherein said leg arrangement comprises a first leg member and a second leg member, said first and second leg members are pivotally connected together at respective first ends thereof, said first leg member is pivotally connected to said base support frame at an intermediate position along said first leg member, and said second leg member is slidably connected to said base support frame at an intermediate position along said second leg member, such that said first and second leg members can be pivoted relative to each other with a pivot angle therebetween being adjustable over a pivot angle range.

13. The crib in accordance with claim 12, wherein said pivot angle range includes a 180° pivot angle, whereby said first and second leg members are horizontally aligned with each other to support said base support frame at said second base height, and an inverted V-shaped pivot angle, whereby said first and second leg members extend relative to each other in an inverted V-shape to support said base support frame at said first base height.

14. The crib in accordance with claim 10, wherein said leg arrangement comprises a first leg member and a second leg member, said first and second leg members are pivotally connected together at respective first ends thereof, said first leg member is pivotally connected to said base support frame at an intermediate position along said first leg member, and said second leg member is slidably connected to said base support frame at an intermediate position along said second leg member, such that said first and second leg members can be pivoted relative to each other with a pivot angle therebetween being adjustable over a pivot angle range.

15. The crib in accordance with claim 14, wherein said pivot angle range includes a 180° pivot angle, whereby said first and second leg members are horizontally aligned with each other to support said base support frame at said second base height, and an inverted V-shaped pivot angle, whereby said first and second leg members extend relative to each other in an inverted V-shape to support said base frame at said first base height.

16. A crib that is selectively configurable into a first configuration in which said crib is adapted for use as a baby bed and a second configuration in which said crib is adapted for use as a Playpen, said crib comprising:

a bed floor member extending horizontally;

a base support frame directly supporting said bed floor member;

an adjustable height leg arrangement connected to said base support frame in such a manner so as to support said base support frame relative to a floor surface selectively at a first base height in said first configuration and at a second base height lower than said first base height in said second configuration;

a plurality of crib wall panels respectively extending vertically upwardly along a peripheral edge of said bed floor member, including at least one adjustable wall panel that is adjustably connected to said base support frame in such a manner so that said adjustable wall panel can be selectively supported relative to said base support frame at a first panel height in said first configuration and at a second panel height higher than said first panel height in said second configuration; and a plurality of corner post members connected to said base support frame, extending upwardly therefrom, and supporting said crib wall panels, wherein said adjustable wall panel is arranged to be vertically slidably held between two of said corner post members, and further comprising a lock pin selectively engageable into one of at least three vertically spaced height adjustment holes provided in said two of said corner post members to selectively adjust said adjustable wall panel into said first panel height, said second panel height and a third panel height different from said first and second panel heights.

17. The crib in accordance with claim 16, wherein a pair of said corner post members are pivotably connected to said base support frame such that a respective one of said crib wall panels supported between said pair of corner post members can be tilted downward to a horizontal position extending along an upper surface plane of said base support frame.

18. A crib that is selectively configurable into a first configuration in which said crib is adapted for use as a baby bed and a second configuration in which said crib is adapted for use as a playpen, said crib comprising:

a bed floor member extending horizontally;

a base support frame directly supporting said bed floor member;

an adjustable height leg arrangement connected to said base support frame in such a manner so as to support said base support frame relative to a floor surface selectively at a first base height in said first configuration and at a second base height lower than said first base height in said second configuration;

a plurality of crib wall panels respectively extending vertically upwardly along a peripheral edge of said bed floor member, including at least one adjustable wall panel that is adjustably connected to said base support frame in such a manner so that said adjustable wall panel can be selectively supported relative to said base support frame at a first panel height in said first configuration and at a second panel height higher than said first panel height in said second configuration;

wherein said leg arrangement comprises leg members that are foldably connected to said base support frame independently of one another, such that said leg members are adapted to be arranged in an extending configuration to support said base support frame at said first base height and are adapted to be folded to support said base support frame in direct contact with the floor surface.

* * * * *